US010866044B2

(12) United States Patent
Kim et al.

(10) Patent No.: US 10,866,044 B2
(45) Date of Patent: Dec. 15, 2020

(54) AMMUNITION MONITORING APPARATUS, SELF-PROPELLED ARTILLERY, AND AMMUNITION CARRIER

(71) Applicant: HANWHA DEFENSE CO., LTD., Changwon-si (KR)

(72) Inventors: Bae Jin Kim, Changwon-si (KR); Byoung Hee Kim, Changwon-si (KR)

(73) Assignee: HANWHA DEFENSE CO., LTD., Changwon-si (KR)

( * ) Notice: Subject to any disclaimer, the term of this patent is extended or adjusted under 35 U.S.C. 154(b) by 0 days.

(21) Appl. No.: 16/098,264

(22) PCT Filed: Sep. 27, 2016

(86) PCT No.: PCT/KR2016/010802
§ 371 (c)(1),
(2) Date: Nov. 1, 2018

(87) PCT Pub. No.: WO2018/026053
PCT Pub. Date: Feb. 8, 2018

(65) Prior Publication Data

US 2019/0120581 A1 Apr. 25, 2019

(30) Foreign Application Priority Data

Aug. 1, 2016 (KR) ..... 10-2016-0098049

(51) Int. Cl.
*F41A 9/50* (2006.01)
*F41A 9/01* (2006.01)
(Continued)

(52) U.S. Cl.
CPC ..... *F41A 9/50* (2013.01); *F41A 9/01* (2013.01); *F41A 9/38* (2013.01); *F41A 17/34* (2013.01);
(Continued)

(58) Field of Classification Search
CPC ..... F41A 9/50; F41A 9/01; F41A 9/38; F41A 17/43; F41A 31/00; F41A 35/00;
(Continued)

(56) References Cited

U.S. PATENT DOCUMENTS 4,976,185 A 12/1990 Wixon et al.
5,177,318 A 1/1993 Martinez et al.
(Continued)

FOREIGN PATENT DOCUMENTS

JP 6-26789 A 2/1994
JP 6-19987 Y2 5/1994
(Continued)

OTHER PUBLICATIONS

Search Report dated Apr. 19, 2017, issued by the International Searching Authority in counterpart International Patent Application No. PCT/KR2016/010802 (PCT/ISA/210).
(Continued)

*Primary Examiner* — Joshua E Freeman
(74) *Attorney, Agent, or Firm* — Sughrue Mion, PLLC

(57) ABSTRACT

An ammunition monitoring apparatus of the present disclosure includes at least one object-position detection sensor and a controller. The at least one object-position detection sensor is installed near a shell or charge route to face at least one set area and to output position information of each shell or charge in the at least one set area. The controller is configured to determine whether a position range occupied by the shell or the charge in the at least one set area exceeds an allowable position range, based on the position information received from the at least one object-position detection sensor, and to output an alert signal indicating a poor position upon determining that the position range occupied by the shell or the charge in the at least one set area exceeds the allowable position range.

8 Claims, 13 Drawing Sheets

(51) Int. Cl.

| | |
|---|---|
| ***F41A 9/38*** | (2006.01) |
| ***F41A 35/00*** | (2006.01) |
| ***F41A 31/00*** | (2006.01) |
| ***F41A 17/34*** | (2006.01) |
| *F41A 23/34* | (2006.01) |
| *F42B 5/38* | (2006.01) |

(52) U.S. Cl.
CPC ..... *F41A 31/00* (2013.01); *F41A 35/00* (2013.01); *F41A 23/34* (2013.01); *F42B 5/38* (2013.01)

(58) Field of Classification Search
CPC . F41A 23/34; B65G 2203/00; B65G 2203/02; B65G 2203/0225; B65G 2203/04; B65G 2203/042; B65G 2203/044; B65G 43/00; B65G 43/08
USPC ..... 89/40.03
See application file for complete search history.

(56) References Cited

U.S. PATENT DOCUMENTS

| | | | | |
|---|---|---|---|---|
| 2015/0219415 | A1 | 8/2015 | Cauley, Jr. et al. | |
| 2018/0313620 | A1* | 11/2018 | Yoon | F41A 9/16 |

FOREIGN PATENT DOCUMENTS

| | | | |
|---|---|---|---|
| JP | 2003-240497 | A | 8/2003 |
| JP | 3905486 | B2 | 4/2007 |
| KR | 10-2002-0020105 | A | 3/2002 |
| KR | 10-0548003 | B1 | 2/2006 |
| KR | 10-2010-0006897 | A | 1/2010 |
| KR | 10-2010-0031405 | A | 3/2010 |
| KR | 10-1555486 | B1 | 9/2015 |
| KR | 10-2016-0003486 | A | 1/2016 |
| KR | 10-1631841 | B1 | 6/2016 |

OTHER PUBLICATIONS

Written Opinion dated Apr. 19, 2017, issued by the International Searching Authority in counterpart International Patent Application No. PCT/KR2016/010802 (PCT/ISA/237).

* cited by examiner

AMMUNITION MONITORING APPARATUS, SELF-PROPELLED ARTILLERY, AND AMMUNITION CARRIER

TECHNICAL FIELD

The present disclosure relates to a self-propelled gun and an ammunition carrier vehicle for providing ammunition (including shells and charges) to the self-propelled gun.

BACKGROUND ART

Self-propelled guns may be classified into manual, semi-automatic, and automatic types.

In a manual self-propelled gun, since an ammunition transporter and an automatic loader are not included, ammunition is manually transported and loaded. In a semi-automatic self-propelled gun, since an ammunition transporter is included but an automatic loader is not included, ammunition is automatically transported and manually loaded. In an automatic self-propelled gun, an ammunition transporter and an automatic loader are included.

The above-described self-propelled guns may have the following problems.

First, when ammunition is poorly positioned while the ammunition is being automatically transported, a delay in firing may occur due to a jam or dislocation of the ammunition (in all of the manual, semi-automatic, and automatic self-propelled guns).

Second, when ammunition is poorly positioned while the ammunition is being manually or automatically loaded into a breech, a delay in firing may occur due to a jam of the ammunition (in all of the manual, semi-automatic, and automatic self-propelled guns).

In an ammunition carrier vehicle for automatically supplying ammunition to a self-propelled gun, when ammunition is poorly positioned while the ammunition is being automatically transported, a delay in firing may occur due to a jam or dislocation of the ammunition.

The above problems of the background art are learned by the present inventors during research on the present disclosure, and may not always be known to the public before application of the present disclosure.

DESCRIPTION OF EMBODIMENTS

Technical Problem

Provided is an ammunition monitoring apparatus capable of preventing a delay in firing due to a jam or dislocation of ammunition when a self-propelled gun fires or an ammunition carrier vehicle supplies ammunition.

Provided is a self-propelled gun employing the ammunition monitoring apparatus.

Provided is an ammunition carrier vehicle employing the ammunition monitoring apparatus.

Solution to Problem

According to an aspect of the present disclosure, an ammunition monitoring apparatus includes at least one object-position detection sensor and a controller.

The at least one object-position detection sensor is installed near a shell or charge route to face at least one set area and to output position information of each shell or charge in the at least one set area.

The controller is configured to determine whether a position range occupied by the shell or the charge in the at least one set area exceeds an allowable position range, based on the position information received from the at least one object-position detection sensor, and to output an alert signal indicating a poor position upon determining that the position range occupied by the shell or the charge in the at least one set area exceeds the allowable position range.

According to another aspect of the present disclosure, a self-propelled gun includes a main controller, a shell magazine configured to store and feed shells, a charge magazine configured to store and feed charges, a multiloader configured to load a shell and a charge into a breech, a shell transporter configured to provide the shells of the shell magazine to the multiloader, and a charge transporter configured to provide the charges of the charge magazine to the multiloader, and further includes a first object-position detection sensor, a second object-position detection sensor, a first servo controller, and a second servo controller.

The first object-position detection sensor is installed near a shell route of the shell transporter to face a first set area and to output position information of each shell in the first set area.

The second object-position detection sensor is installed near a charge route of the charge transporter to face a second set area and to output position information of each charge in the second set area.

The first servo controller is configured to control operation of the shell transporter under control of the main controller, to determine whether a position range occupied by the shell in the first set area exceeds an allowable position range, based on the position information received from the first object-position detection sensor, and to output an alert signal indicating a poor position upon determining that the position range occupied by the shell in the first set area exceeds the allowable position range.

The second servo controller is configured to control operation of the charge transporter under control of the main controller, to determine whether a position range occupied by the charge in the second set area exceeds an allowable position range, based on the position information received from the second object-position detection sensor, and to output an alert signal indicating a poor position upon determining that the position range occupied by the charge in the second set area exceeds the allowable position range.

According to another aspect of the present disclosure, an ammunition carrier vehicle includes a main controller, a shell magazine configured to store and feed shells, a charge magazine configured to store and feed charges, a conveyor configured to convey the shells and the charges, a shell transporter configured to provide the shells of the shell magazine to the conveyor, and a charge transporter configured to provide the charges of the charge magazine to the conveyor, and further includes a first object-position detection sensor, a second object-position detection sensor, a first servo controller, and a second servo controller.

The first object-position detection sensor is installed near a shell route of the shell transporter to face a first set area and to output position information of each shell in the first set area.

The second object-position detection sensor is installed near a charge route of the charge transporter to face a second set area and to output position information of each charge in the second set area.

The first servo controller is configured to control operation of the shell transporter under control of the main controller, to determine whether a position range occupied by the shell in the first set area exceeds an allowable position range, based on the position information received from the first object-position detection sensor, and to output an alert signal indicating a poor position upon determining that the position range occupied by the shell in the first set area exceeds the allowable position range.

The second servo controller is configured to control operation of the charge transporter under control of the main controller, to determine whether a position range occupied by the charge in the second set area exceeds an allowable position range, based on the position information received from the second object-position detection sensor, and to output an alert signal indicating a poor position upon determining that the position range occupied by the charge in the second set area exceeds the allowable position range.

Advantageous Effects of Disclosure

Based on an ammunition monitoring apparatus, a self-propelled gun, and an ammunition carrier vehicle according to embodiments of the present disclosure, a position of a shell or a charge may be determined using at least one object-position detection sensor, and an alert signal may be output when the shell or the charge is poorly positioned.

Therefore, when the self-propelled gun fires or the ammunition carrier vehicle supplies ammunition, a delay in firing due to a jam or dislocation of ammunition may be prevented.

BEST MODE

The following descriptions and the attached drawings are provided to understand operations of the present disclosure and some operations that can be easily realized by one of ordinary skill in the art may not be described.

Also, the present specification and the drawings are not provided to limit the scope of the disclosure which should be defined by the following claims. Terms used herein should be construed as having meanings and concepts corresponding to the technical idea of the present disclosure in order to the most appropriately describe the disclosure.

Hereinafter, the present disclosure will be described in detail by explaining embodiments of the disclosure with reference to the attached drawings.

Figure 1:
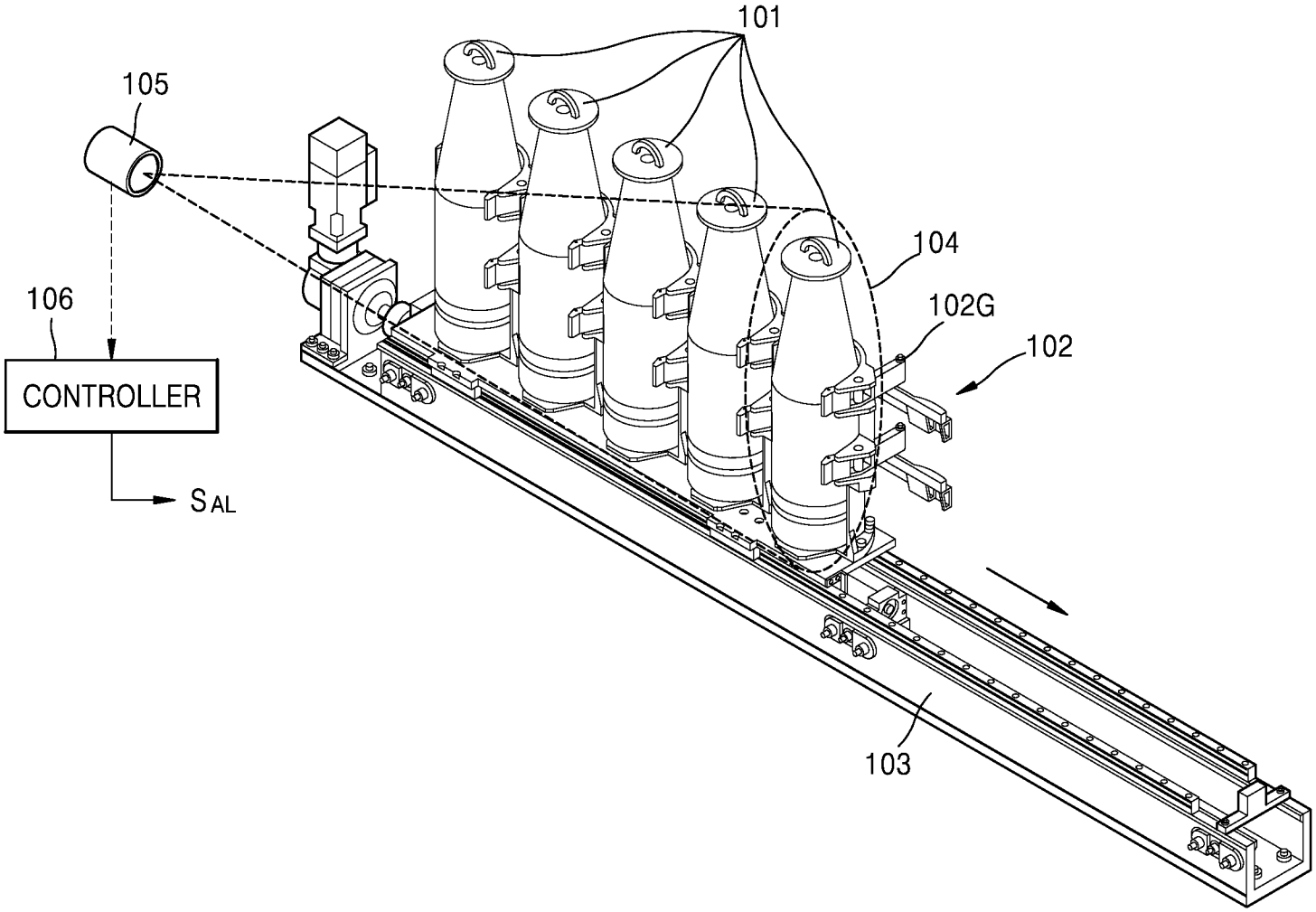
FIG. 1 is a perspective view of an ammunition monitoring apparatus according to an embodiment of the present disclosure.

FIG. 1 is a perspective view of an ammunition monitoring apparatus according to an embodiment of the present disclosure. In FIG. 1, reference numeral 101 denotes shells (or charges), reference numeral 102 denotes a transporter of the shells (or charges) 101, reference numeral 102G denotes grippers, and reference numeral 103 denotes transport rails. The ammunition monitoring apparatus of the current embodiment will now be described with reference to FIG. 1.

The ammunition monitoring apparatus of the current embodiment includes at least one object-position detection sensor 105 and a controller 106.

The at least one object-position detection sensor 105 is installed near a shell or charge route to face at least one set area 104 and outputs position information of each shell (or charge) 101 in the at least one set area 104.

The controller 106 determines whether a position range occupied by the shell (or charge) 101 in the at least one set area 104 exceeds an allowable position range, based on the position information received from the at least one object-position detection sensor 105, and outputs an alert signal SAL indicating a poor position upon determining that the position range occupied by the shell (or charge) 101 in the at least one set area 104 exceeds the allowable position range.

According to the ammunition monitoring apparatus of the embodiment of FIG. 1, the position of the shell (or charge) 101 may be determined and the alert signal SAL may be output upon determining that the shell (or charge) 101 is poorly positioned, by using the at least one object-position detection sensor 105.

Therefore, when a self-propelled gun fires or an ammunition carrier vehicle supplies ammunition, a delay in firing due to a jam or dislocation of ammunition may be prevented. For example, the position of the shell (or charge) 101 may be corrected by slightly releasing and then regripping the shell (or charge) 101 by using the gripper $\mathbf{102}_G$ of the transporter 102.

Figure 2A:
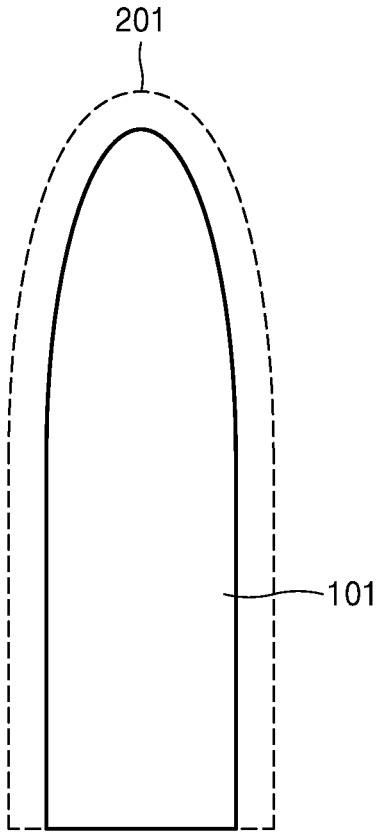
FIGS. 2A to 2C are cross-sectional views for describing operation of a controller of FIG. 1 in a case when at least one object-position detection sensor of FIG. 1 is at least one camera.
Figure 2B:
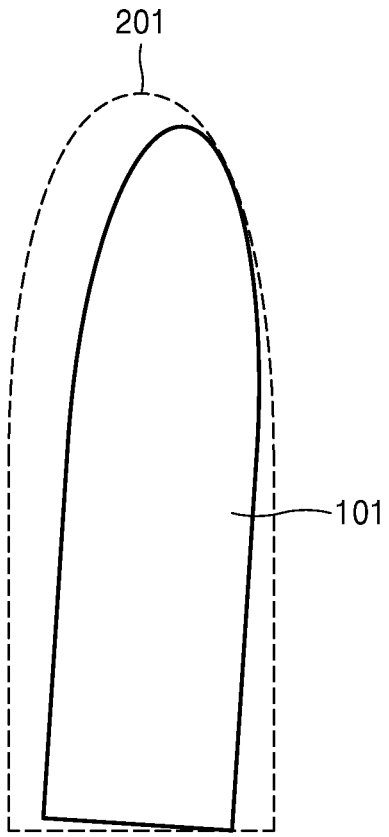
Figure 2C:
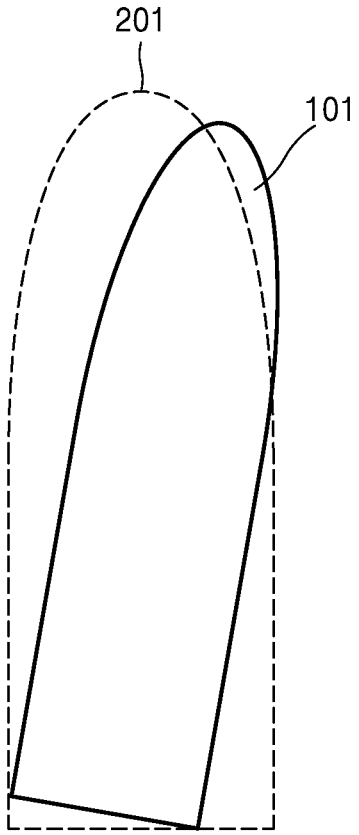

FIGS. 2A to 2C are cross-sectional views for describing operation of the controller 106 of FIG. 1 in a case when the at least one object-position detection sensor 105 of FIG. 1 is at least one camera.

Referring to FIGS. 1 and 2A to 2C, when the at least one object-position detection sensor 105 is at least one camera, the controller 106 sets, in the set area 104 (see FIG. 2A), a virtual shape 201 larger than the shape of the shell (or charge) 101.

The controller 106 outputs the alert signal SAL indicating a poor position upon determining that the shape of the shell (or charge) 101 in the set area 104 exceeds the virtual shape 201. FIG. 2B corresponds to a case when the shape of the shell (or charge) 101 in the set area 104 does not exceed the virtual shape 201. FIG. 2C corresponds to a case when the shape of the shell (or charge) 101 in the set area 104 exceeds the virtual shape 201.

Figure 3:
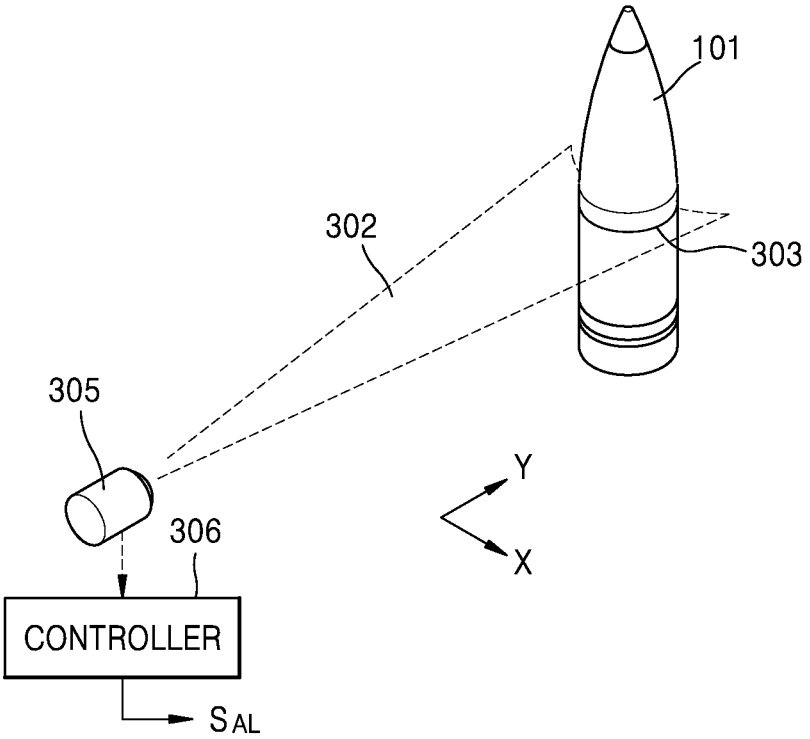
FIG. 3 is a perspective view for describing operation of a controller in a case when the at least one object-position detection sensor of FIG. 1 is at least one two-dimensional (2D) laser sensor.

FIG. 3 is a perspective view for describing operation of a controller 306 in a case when the at least one object-position detection sensor 105 of FIG. 1 is at least one two-dimensional (2D) laser sensor 305. In FIG. 3, reference numeral 302 denotes a single horizontal linear laser beam and reference numeral 303 denotes a single horizontal line of the shell (or charge) 101.

Referring to FIG. 3, the 2D laser sensor 305 obtains position information of the single horizontal line 303 of the shell (or charge) 101 by irradiating the laser beam 302 of a single horizontal line onto the set area 104 (see FIG. 1).

The position information of the single horizontal line 303 of the shell (or charge) 101 includes a distance coordinate (Y-axis coordinate) and a horizontal-direction coordinate (X-axis coordinate) of every point of the single horizontal line 303 of the shell (or charge) 101.

The controller 306 sets an allowable range of the distance coordinate (Y-axis coordinate) and an allowable range of the horizontal-direction coordinate (X-axis coordinate). In addition, the controller 306 outputs the alert signal SAL indicating a poor position upon determining that the distance coordinate (Y-axis coordinate) or the horizontal-direction coordinate (X-axis coordinate) received from the 2D laser sensor 305 exceeds the allowable range.

Figure 4:
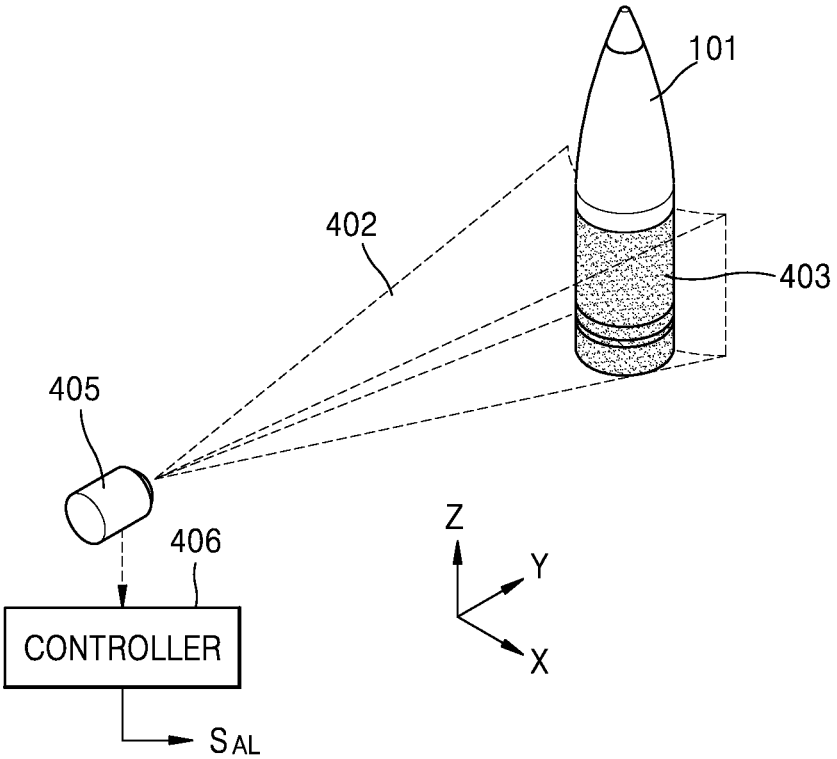
FIG. 4 is a perspective view for describing operation of a controller in a case when the at least one object-position detection sensor of FIG. 1 is at least one three-dimensional (3D) laser sensor.

FIG. 4 is a perspective view for describing operation of a controller 406 in a case when the at least one object-position detection sensor 105 of FIG. 1 is at least one three-dimensional (3D) laser sensor 405. In FIG. 4, reference numeral 402 denotes laser beams of horizontal and vertical directions and reference numeral 403 denotes a part of the shell (or charge) 101.

Referring to FIG. 4, the 3D laser sensor 405 obtains position information of the shell (or charge) 101 by irradiating the laser beam 402 of horizontal and vertical directions onto the set area 104 (see FIG. 1).

The position information of the shell (or charge) 101 includes a distance coordinate (Y-axis coordinate), a horizontal-direction coordinate (X-axis coordinate), and a vertical-direction coordinate (Z-axis coordinate) of every point of the shell (or charge) 101.

The controller 406 sets an allowable range of the distance coordinate (Y-axis coordinate), an allowable range of the horizontal-direction coordinate (X-axis coordinate), and an allowable range of the vertical-direction coordinate (Z-axis coordinate). In addition, the controller 406 outputs the alert signal SAL indicating a poor position upon determining that the distance coordinate (Y-axis coordinate), the horizontal-direction coordinate (X-axis coordinate), or the vertical-direction coordinate (Z-axis coordinate) received from the 3D laser sensor 405 exceeds the allowable range.

Referring to FIG. 1, when the at least one set area 104 (see FIG. 1) includes multiple set areas, the at least one object-position detection sensor 105 includes multiple object-position detection sensors respectively corresponding to the multiple set areas.

Herein, the controller 106 sets a reference position range smaller than the allowable position range and stores rates of the position range occupied by the shell (or charge) 101 between the reference position range and the allowable position range in the multiple set areas. In addition, the controller 106 outputs a correction request signal for a set area in which the rate of the position range occupied by the shell (or charge) 101 continuously increases.

Figure 5A:
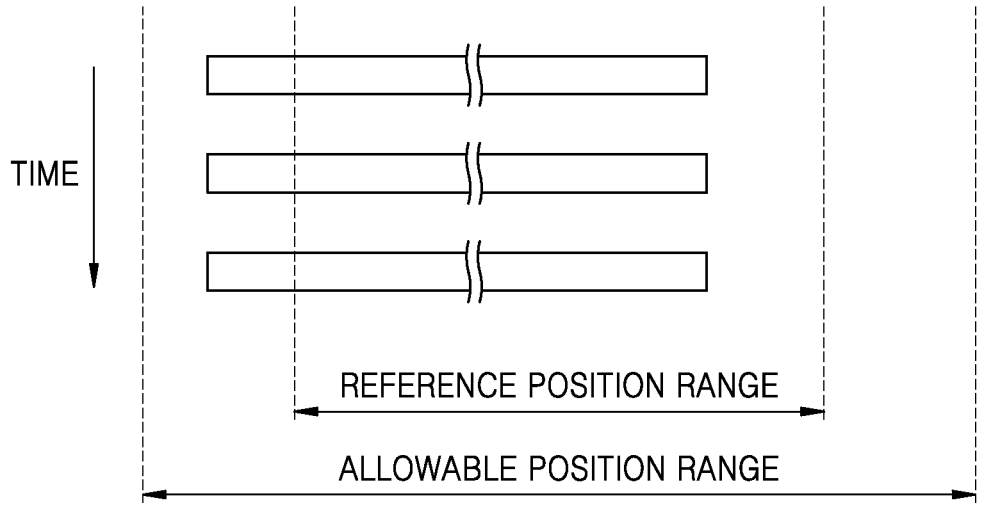
FIG. 5A is a view showing a first example of a position range occupied by a shell or a charge in a set area of FIG. 1.

FIG. 5A is a view showing a first example of the position range occupied by the shell (or charge) 101 in the set area 104 of FIG. 1. Referring to FIG. 5A, the rate of the position range occupied by the shell (or charge) 101 between the reference position range and the allowable position range does not continuously increase.

Figure 5B:
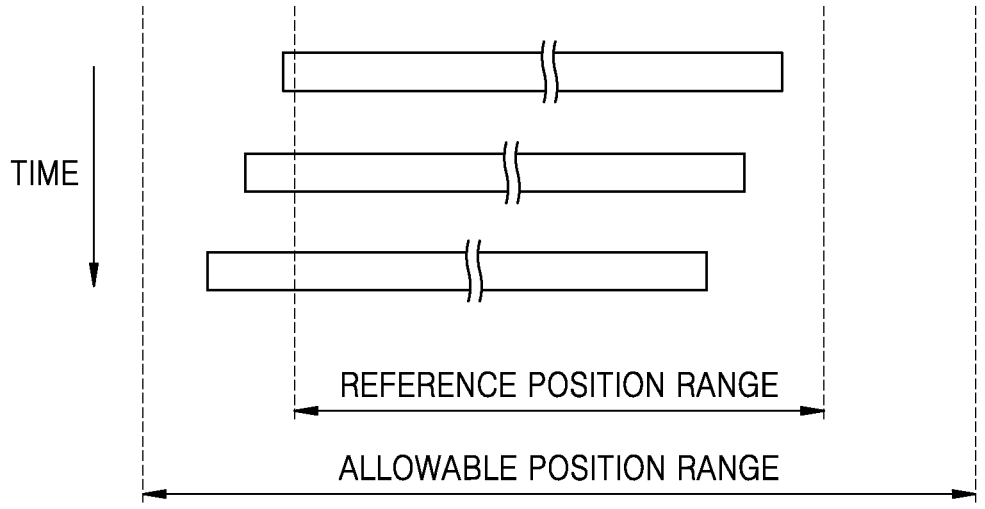
FIG. 5B is a view showing a second example of the position range occupied by the shell or the charge in the set area of FIG. 1.

FIG. 5B is a view showing a second example of the position range occupied by the shell (or charge) 101 in the set area 104 of FIG. 1. Referring to FIG. 5B, the rate of the position range occupied by the shell (or charge) 101 between the reference position range and the allowable position range continuously increases. When the number of times that the rate continuously increases reaches a reference number of times, the controller 106 outputs the correction request signal for a set area in which the rate continuously increases.

Therefore, a hardly-noticeable defect of any one set area may be easily found and corrected.

The controller 106 determines whether the shell (or charge) 101 is inverted in the at least one set area 104, based on the position information received from the at least one object-position detection sensor 105, and outputs an alert signal indicating invertedness upon determining that the shell (or charge) 101 is inverted in the at least one set area 104.

Therefore, when a self-propelled gun fires or an ammunition carrier vehicle supplies ammunition, a delay in firing due to unexpected invertedness of ammunition may be prevented.

In addition, the controller 106 determines whether a charge in the at least one set area 104 has a set size, based on the position information received from the at least one object-position detection sensor 105, and outputs an alert signal indicating an incorrect charge upon determining that the charge does not have the set size.

Therefore, when a self-propelled gun fires or an ammunition carrier vehicle supplies ammunition, an error or delay in firing due to an unexpected incorrect charge may be prevented.

Furthermore, the controller 106 counts shells or charges passing through the at least one set area 104, based on the position information received from the at least one object-position detection sensor 105.

Therefore, when a self-propelled gun fires or an ammunition carrier vehicle supplies ammunition, the amount of ammunition may be monitored in real time.

Figure 6:
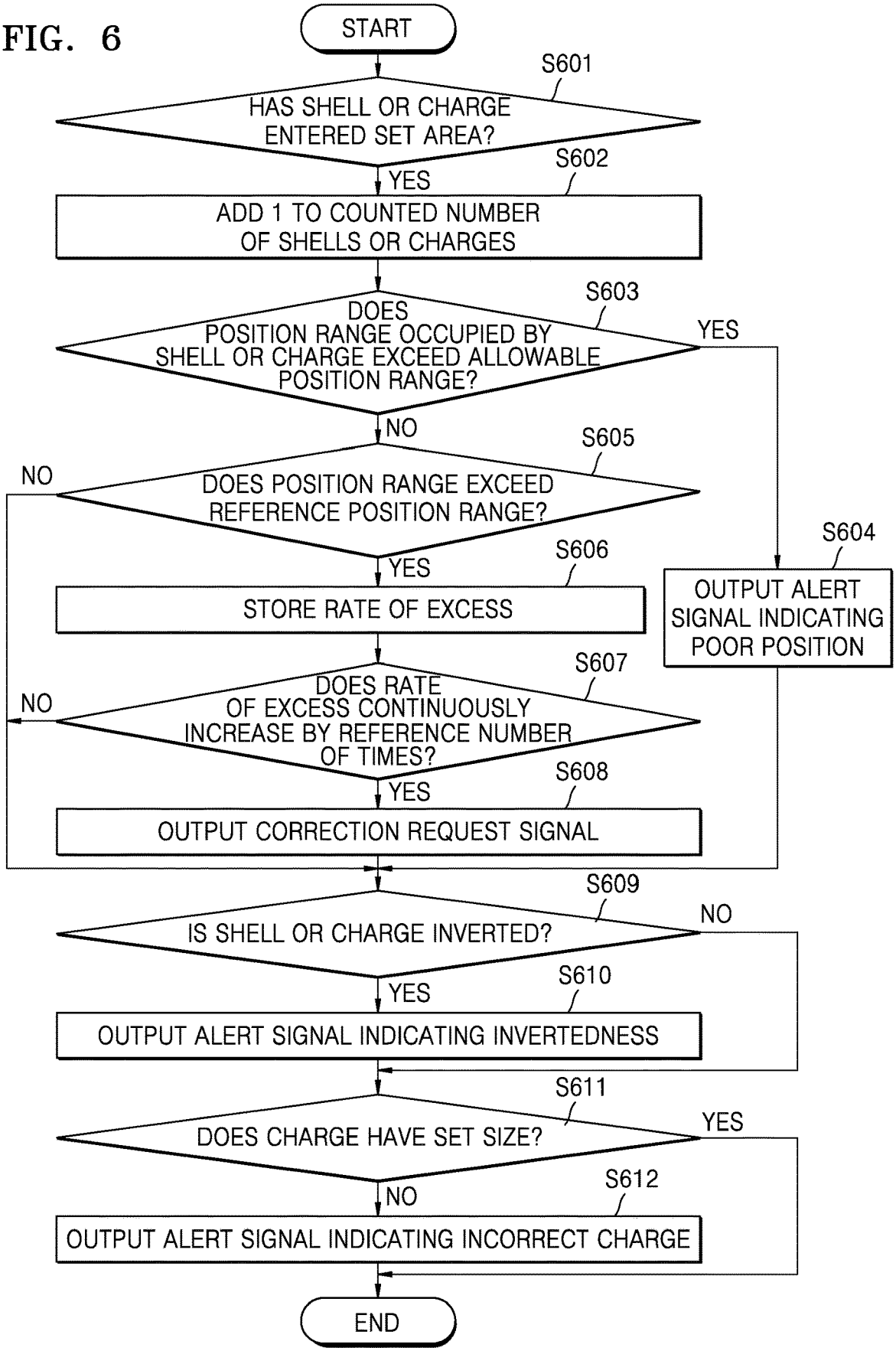
FIG. 6 is a flowchart for describing operation of the controller for any one set area of FIG. 1.

An operation algorithm of the controller 106 including the above-described additional operations is illustrated in FIG. 6.

FIG. 6 is a flowchart for describing operation of the controller 106 for any one set area 104 of FIG. 1. The operation of the controller 106 will now be described with reference to FIGS. 1, 5A, 5B, and 6.

When the shell (or charge) 101 enters the set area 104 (operation S601), 1 is added to a counted number of shells (or charges) 101 (operation S602). That is, the controller 106 counts shells or charges passing through the set area 104, based on position information received from the at least one object-position detection sensor 105. As such, when a self-propelled gun fires or an ammunition carrier vehicle supplies ammunition, the amount of ammunition may be monitored in real time.

The controller 106 determines whether a position range occupied by the shell (or charge) 101 exceeds an allowable position range (operation S603). Upon determining that the position range occupied by the shell (or charge) 101 exceeds the allowable position range, the controller 106 outputs an alert signal indicating a poor position (operation S604). As such, when a self-propelled gun fires or an ammunition carrier vehicle supplies ammunition, a delay in firing due to a jam or dislocation of ammunition may be prevented. After operation S604 is performed, the controller 106 performs operation S609 and operations subsequent thereto.

Upon determining that the position range occupied by the shell (or charge) 101 does not exceed the allowable position range, the controller 106 determines whether the position range occupied by the shell (or charge) 101 exceeds a reference position range (operation S605). Upon determining that the position range occupied by the shell (or charge) 101 does not exceed the reference position range, the controller 106 performs operation S609 and operations subsequent thereto.

Upon determining that the position range occupied by the shell (or charge) 101 exceeds the reference position range, the controller 106 stores a rate of excess (operation S606). Herein, the rate of excess refers to a rate of the position range occupied by the shell (or charge) 101 between the reference position range and the allowable position range.

Then, upon determining that the rate of excess continuously increases by a reference number of times (operation S607), the controller 106 outputs a correction request signal (operation S608). As such, a hardly-noticeable defect of a corresponding set area may be easily found and corrected.

Then, the controller 106 determines whether the shell (or charge) 101 is inverted in the set area 104, based on the position information received from the object-position detection sensor 105 (operation S609). Upon determining that the shell (or charge) 101 is inverted in the set area 104, the controller 106 outputs an alert signal indicating invertedness (operation S610). As such, when a self-propelled gun fires or an ammunition carrier vehicle supplies ammunition, a delay in firing due to unexpected invertedness of ammunition may be prevented.

The controller 106 determines whether a charge in the set area 104 has a set size, based on the position information received from the object-position detection sensor 105 (operation S611). Upon determining that the charge does not have the set size, the controller 106 outputs an alert signal indicating an incorrect charge (operation S612). As such, when a self-propelled gun fires or an ammunition carrier vehicle supplies ammunition, an error or delay in firing due to an unexpected incorrect charge may be prevented.

Figure 7:
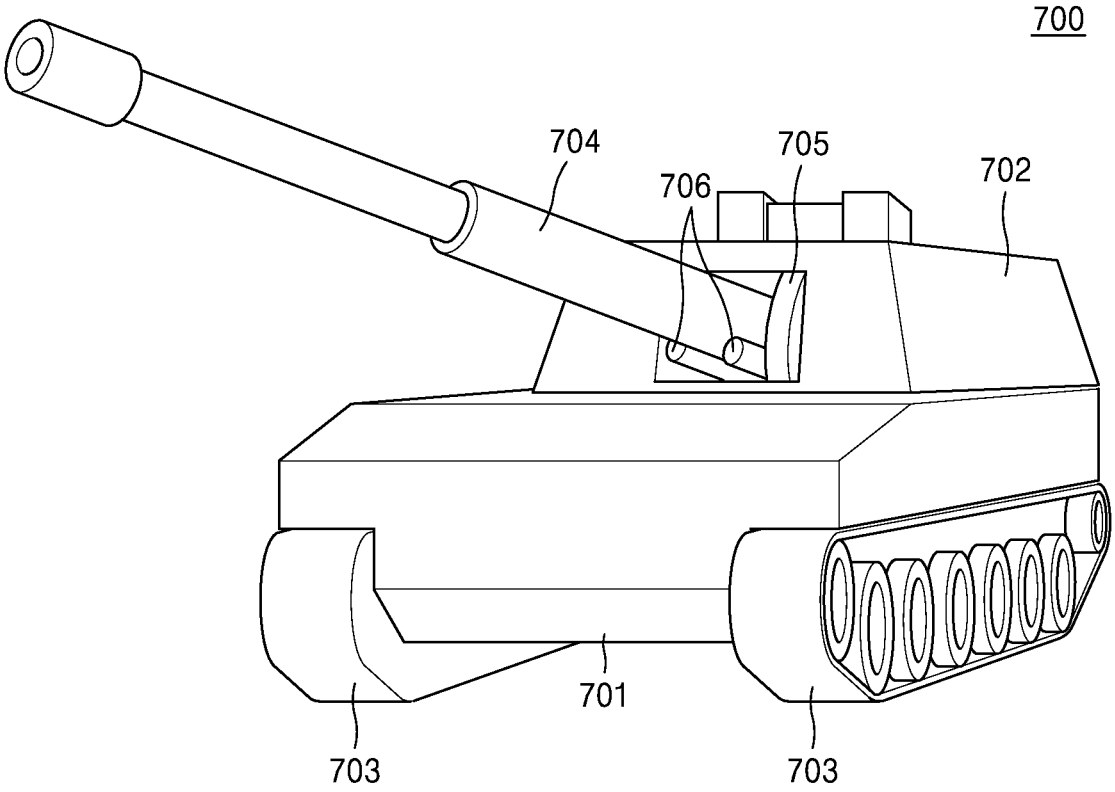
FIG. 7 is a perspective view showing the exterior of a self-propelled gun according to an embodiment of the present disclosure.

FIG. 7 is a perspective view showing the exterior of a self-propelled gun 700 according to an embodiment of the present disclosure.

Referring to FIG. 7, the self-propelled gun 700 of the current embodiment includes a main body 701, a turret 702, a mobility part 703, a gun barrel 704, a gun barrel support 705, and a recoil buffer 706.

The gun barrel 704 includes rifling therein and includes a breech block at a tail thereof. When a shell is fired from the gun barrel 704 due to detonation of a charge, the gun barrel 704 retreats and then is restored by the gun barrel support 705.

The gun barrel support 705 supporting the gun barrel 704 is mounted on the turret 702 or the main body 701.

The main body 701 is armored and includes a space for crews, a space for shell and charge magazines, a control device for shooting and steering, etc. therein. The overall configuration of the self-propelled gun 700 will be described in detail below with reference to FIG. 8.

The turret 702 is rotatably mounted on the main body 701, and a machine gun or the like may be mounted thereon as secondary armament.

The mobility part 703 may be mounted on the main body 701 to move the main body 701.

The recoil buffer 706 mounted between the gun barrel 704 and the gun barrel support 7055 effectively absorbs impact applied to the gun barrel 704 when a shell is fired due to detonation of a charge.

Figure 8:
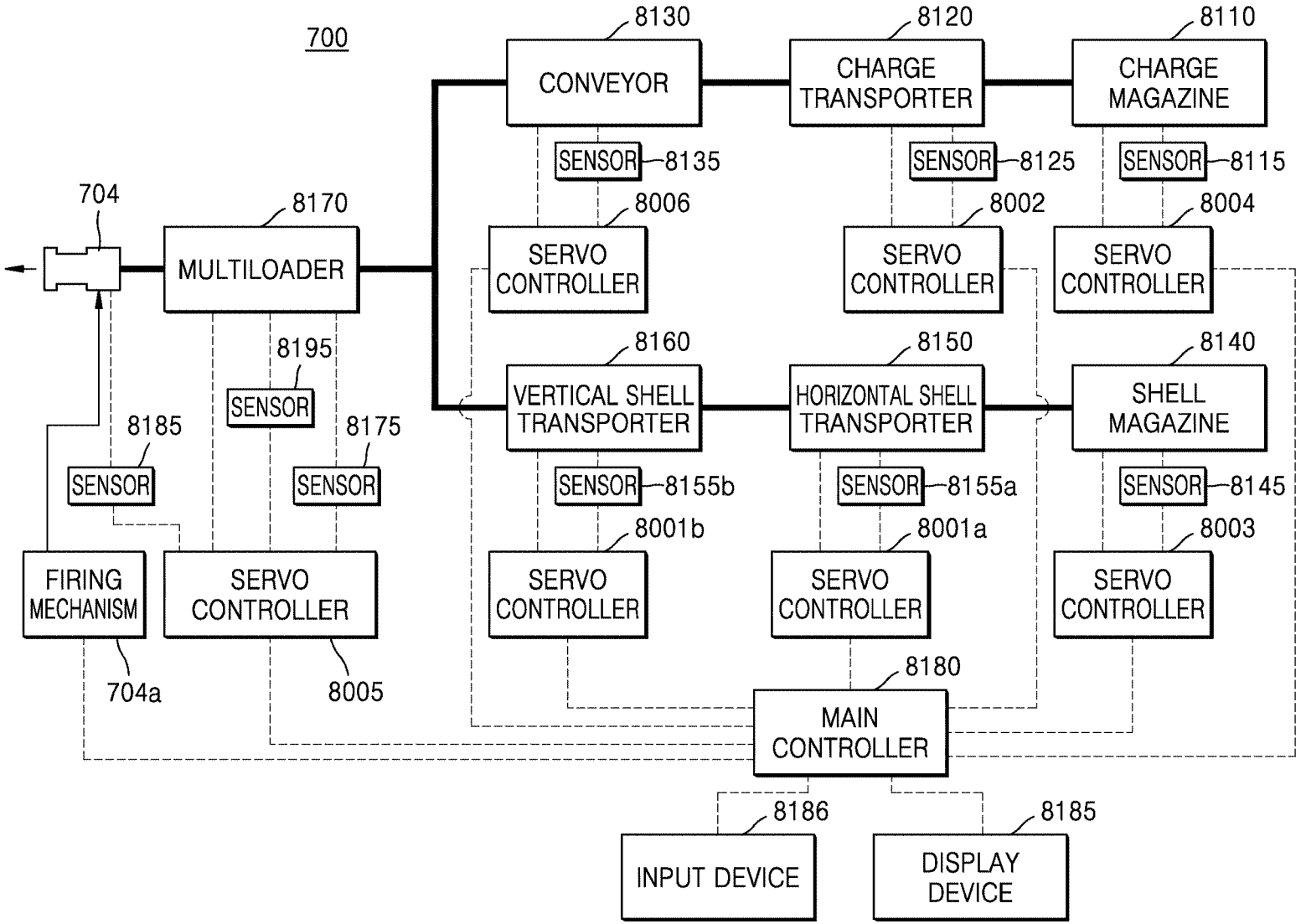
FIG. 8 is a block diagram showing the internal configuration of the self-propelled gun of FIG. 7.

FIG. 8 is a block diagram showing the internal configuration of the self-propelled gun 700 of FIG. 7. In FIGS. 7 and 8, like reference numerals denote like elements. In FIG. 8, reference numeral 704 denotes a gun barrel, reference numeral 704*a* denotes a firing mechanism for detonating a loaded charge, reference numeral 8185 denotes a display device, reference numeral 8186 denotes an input device, and reference numeral 8130 denotes a conveyor. The internal configuration of the self-propelled gun 700 will now be described with reference to FIG. 8.

The self-propelled gun 700 of the current embodiment includes a main controller 8180, a shell magazine 8140 configured to store and feed shells, a charge magazine 8110 configured to store and feed charges, a multiloader 8170 configured to load a shell and a charge into a breech, a shell transporter (collectively denoted by 8150 and 8160) configured to provide the shells of the shell magazine 8140 to the multiloader 8170, and a charge transporter 8120 configured to provide the charges of the charge magazine 8110 to the multiloader 8170, and further includes a first object-position detection sensor (collectively denoted by 8155*a* and 8155*b*), a second object-position detection sensor 8125, a first servo controller (collectively denoted by 8001*a* and 8001*b*), and a second servo controller 8002.

The first object-position detection sensor (collectively denoted by 8155*a* and 8155*b*) is installed near a shell route of the shell transporter (collectively denoted by 8150 and 8160) to face a first set area and outputs position information of each shell in the first set area.

The second object-position detection sensor 8125 is installed near a charge route of the charge transporter 8120 to face a second set area and outputs position information of each charge in the second set area.

The first servo controller (collectively denoted by 8001*a* and 8001*b*) operates under the control of the main controller 8180 and controls operation of the shell transporter (collectively denoted by 8150 and 8160). In addition, the first servo controller (collectively denoted by 8001*a* and 8001*b*) determines whether a position range occupied by the shell in the first set area (collectively denoted by a first-a set area and a first-b set area) exceeds an allowable position range, based on the position information received from the first object-position detection sensor (collectively denoted by 8155*a* and 8155*b*). The first servo controller (collectively denoted by 8001*a* and 8001*b*) outputs an alert signal indicating a poor position upon determining that the position range occupied by the shell in the first set area (collectively denoted by the first-a set area and the first-b set area) exceeds the allowable position range.

As such, when the self-propelled gun 700 fires, a delay in firing due to a jam or dislocation of a shell on a shell route of the shell transporter (collectively denoted by 8150 and 8160) may be prevented. For example, the position of the shell may be corrected by slightly releasing and then regripping the shell by using the gripper $\mathbf{102}_G$ (see FIG. 1) of the shell transporter (collectively denoted by 8150 and 8160). Furthermore, the first servo controller (collectively denoted by 8001*a* and 8001*b*) performs the operation described above in relation to FIG. 6, on the shell which is moving.

In the current embodiment, the shell transporter (collectively denoted by 8150 and 8160) includes a horizontal shell transporter 8150 and a vertical shell transporter 8160.

The horizontal shell transporter 8150 transports the shells of the shell magazine 8140 in a horizontal direction and provides the shells to the vertical shell transporter 8160. The vertical shell transporter 8160 transports, in a vertical direction, the shells received from the horizontal shell transporter 8150 and provides the shells to the multiloader 8170.

The first object-position detection sensor (collectively denoted by 8155*a* and 8155*b*) includes a first-a object-position detection sensor 8155*a* and a first-b object-position detection sensor 8155*b*.

The first-a object-position detection sensor 8155*a* is installed near a shell route of the horizontal shell transporter 8150 to face the first-a set area and outputs position information of each shell in the first-a set area. The first-b object-position detection sensor 8155*b* is installed near a shell route of the vertical shell transporter 8160 to face the first-b set area and outputs position information of each shell in the first-b set area.

Likewise, the first servo controller (collectively denoted by 8001*a* and 8001*b*) includes a first-a servo controller 8001*a* and a first-b servo controller 8001*b*.

The first-a servo controller 8001*a* controls operation of the horizontal shell transporter 8150. The first-a servo controller 8001*a* determines whether a position range occupied by the shell in the first-a set area exceeds an allowable position range, based on the position information received from the first-a object-position detection sensor 8155*a*. The first-a servo controller 8001*a* outputs an alert signal indicating a poor position upon determining that the position range occupied by the shell in the first-a set area exceeds the allowable position range.

The first-b servo controller 8001*b* controls operation of the vertical shell transporter 8160. The first-b servo controller 8001*b* determines whether a position range occupied by the shell in the first-b set area exceeds an allowable position range, based on the position information received from the first-b object-position detection sensor 8155*b*. The first-b servo controller 8001*b* outputs an alert signal indicating a poor position upon determining that the position range occupied by the shell in the first-b set area exceeds the allowable position range.

The second servo controller 8002 operates under the control of the main controller 8180 and controls operation of the charge transporter 8120. In addition, the second servo controller 8002 determines whether a position range occupied by the charge in the second set area exceeds an allowable position range, based on the position information received from the second object-position detection sensor 8125. Upon determining that the position range occupied by the charge in the second set area exceeds the allowable position range, the second servo controller 8002 outputs an alert signal indicating a poor position.

As such, when the self-propelled gun 700 fires, a delay in firing due to a jam or dislocation of a charge on a charge route of the charge transporter 8120 may be prevented. For example, the position of the charge may be corrected by slightly releasing and then regripping the charge by using a gripper of the charge transporter 8120. Furthermore, the second servo controller 8002 performs the operation described above in relation to FIG. 6, on the charge which is moving.

In the current embodiment, the self-propelled gun 700 further includes a third object-position detection sensor 8145 and a third servo controller 8003.

The third object-position detection sensor 8145 is installed near a shell route of the shell magazine 8140 to face a third set area. The third object-position detection sensor 8145 outputs position information of each shell in the third set area.

The third servo controller 8003 operates under the control of the main controller 8180 and controls operation of the shell magazine 8140. The third servo controller 8003 determines whether a position range occupied by the shell in the third set area exceeds an allowable position range, based on the position information received from the third object-position detection sensor 8145. Upon determining that the position range occupied by the shell in the third set area exceeds the allowable position range, the third servo controller 8003 outputs an alert signal indicating a poor position.

As such, when the self-propelled gun 700 fires, a delay in firing due to a jam or dislocation of a shell on a shell route of the shell magazine 8140 may be prevented. Furthermore, the third servo controller 8003 performs the operation described above in relation to FIG. 6, on the shell which is moving.

In the current embodiment, the self-propelled gun 700 further includes a fourth object-position detection sensor 8115 and a fourth servo controller 8004.

The fourth object-position detection sensor 8115 is installed near a charge route of the charge magazine 8110 to face a fourth set area. The fourth object-position detection sensor 8115 outputs position information of each charge in the fourth set area.

The fourth servo controller 8004 operates under the control of the main controller 8180 and controls operation of the charge magazine 8110. The fourth servo controller 8004 determines whether a position range occupied by the charge in the fourth set area exceeds an allowable position range, based on the position information received from the fourth object-position detection sensor 8115. Upon determining that the position range occupied by the charge in the fourth set area exceeds the allowable position range, the fourth servo controller 8004 outputs an alert signal indicating a poor position.

As such, when the self-propelled gun 700 fires, a delay in firing due to a jam or dislocation of a charge on a charge route of the charge magazine 8110 may be prevented. Furthermore, the fourth servo controller 8004 performs the operation described above in relation to FIG. 6, on the charge which is moving.

In the current embodiment, the self-propelled gun 700 further includes a fifth-a object-position detection sensor 8175, a fifth-b object-position detection sensor 8195, and a fifth servo controller 8005.

The fifth-a object-position detection sensor 8175 is installed near a shell route of the multiloader 8170 to face a fifth-a set area. The fifth-a object-position detection sensor 8175 outputs position information of each shell in the fifth-a set area.

The fifth-b object-position detection sensor 8195 is installed near a charge route of the multiloader 8170 to face a fifth-b set area. The fifth-b object-position detection sensor 8195 outputs position information of each charge in the fifth-b set area.

The fifth servo controller 8005 operates under the control of the main controller 8180 and controls operation of the multiloader 8170. The fifth servo controller 8005 determines whether a position range occupied by the shell or the charge in the fifth-a or fifth-b set area exceeds an allowable position range, based on the position information received from the fifth-a or fifth-b object-position detection sensor 8175 or 8195. Upon determining that the position range occupied by the shell or the charge in the fifth-a or fifth-b set area exceeds the allowable position range, the fifth servo controller 8005 outputs an alert signal indicating a poor position.

As such, when the self-propelled gun 700 fires, a delay in firing due to a jam or dislocation of ammunition (a shell or a charge) on a shell or charge route of the multiloader 8170 may be prevented. Furthermore, the fifth servo controller 8005 performs the operation described above in relation to FIG. 6, on ammunition (e.g., the shell and the charge) which is moving.

Figure 9:
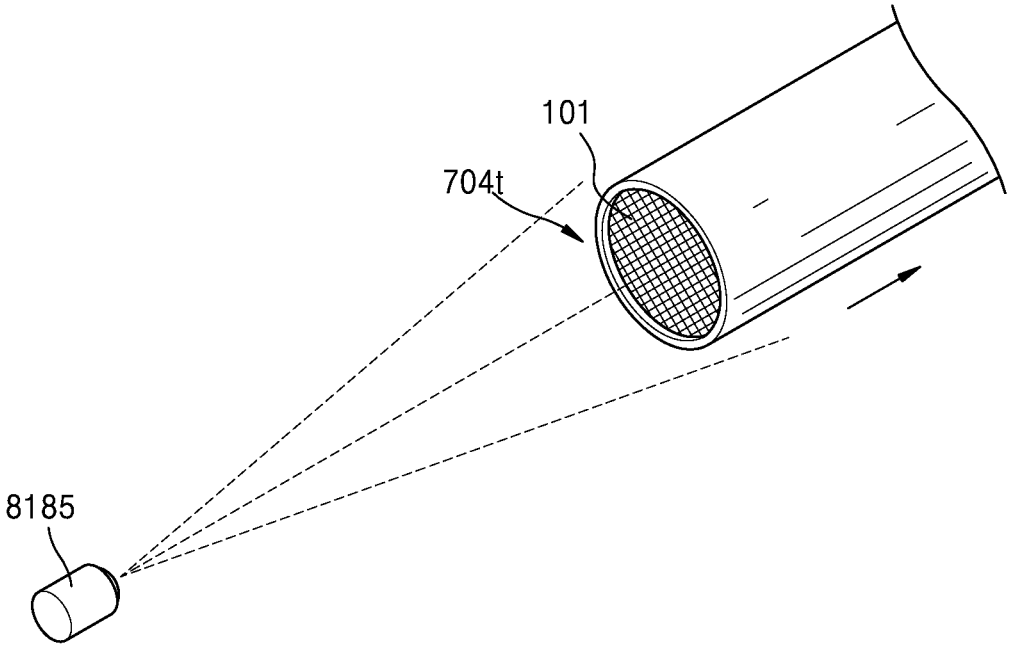
FIG. 9 is a perspective view showing that a fifth-c object-position detection sensor of FIG. 8 is installed to face a breech.

FIG. 9 is a perspective view showing that a fifth-c object-position detection sensor 8185 of FIG. 8 is installed in a forward direction to face the center of an entrance of a breech 704*t*. In FIG. 9, an arrow direction indicates a direction in which ammunition (a shell and a charge) is loaded.

Referring to FIGS. 8 and 9, the fifth-c object-position detection sensor 8185 is installed in a forward direction to face the center of an entrance of the breech 704*t* (or a gun barrel). The fifth-c object-position detection sensor 8185 outputs position information of a rear surface of the shell (or charge) 101 loaded in the breech 704*t*.

The fifth servo controller 8005 determines whether a position range occupied by the shell (or charge) 101 in the breech 704*t* exceeds an allowable position range while the shell (or charge) 101 is loaded in the breech 704*t*. Upon determining that the position range occupied by the shell (or charge) 101 in the breech 704*t* exceeds the allowable position range, the fifth servo controller 8005 outputs an alert signal indicating a poor position.

As such, when the self-propelled gun 700 fires, a delay in firing due to a jam of ammunition (a shell or a charge) in the breech 704*t* may be prevented.

Figure 10:
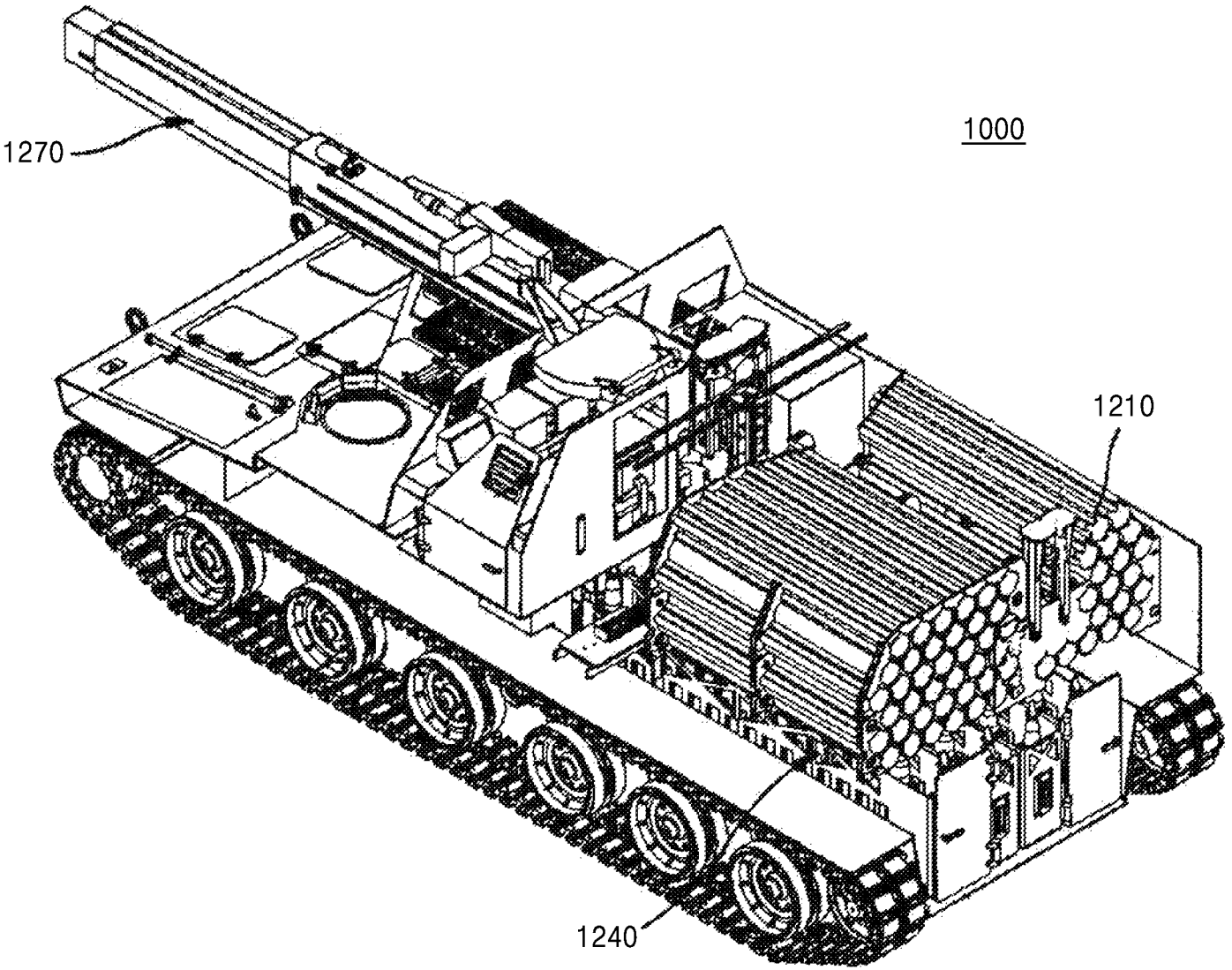
FIG. 10 is a perspective view showing the structure of an ammunition carrier vehicle according to an embodiment of the present disclosure.

FIG. 10 is a perspective view showing the structure of an ammunition carrier vehicle 1000 according to an embodiment of the present disclosure.

Referring to FIG. 10, a shell magazine 1240, a charge magazine 1210, and a final conveyor 1270 are mounted on the ammunition carrier vehicle 1000 of the current embodiment. In FIG. 10, a cover for covering the shell magazine 1240, the charge magazine 1210, etc. is not illustrated.

Figure 11:
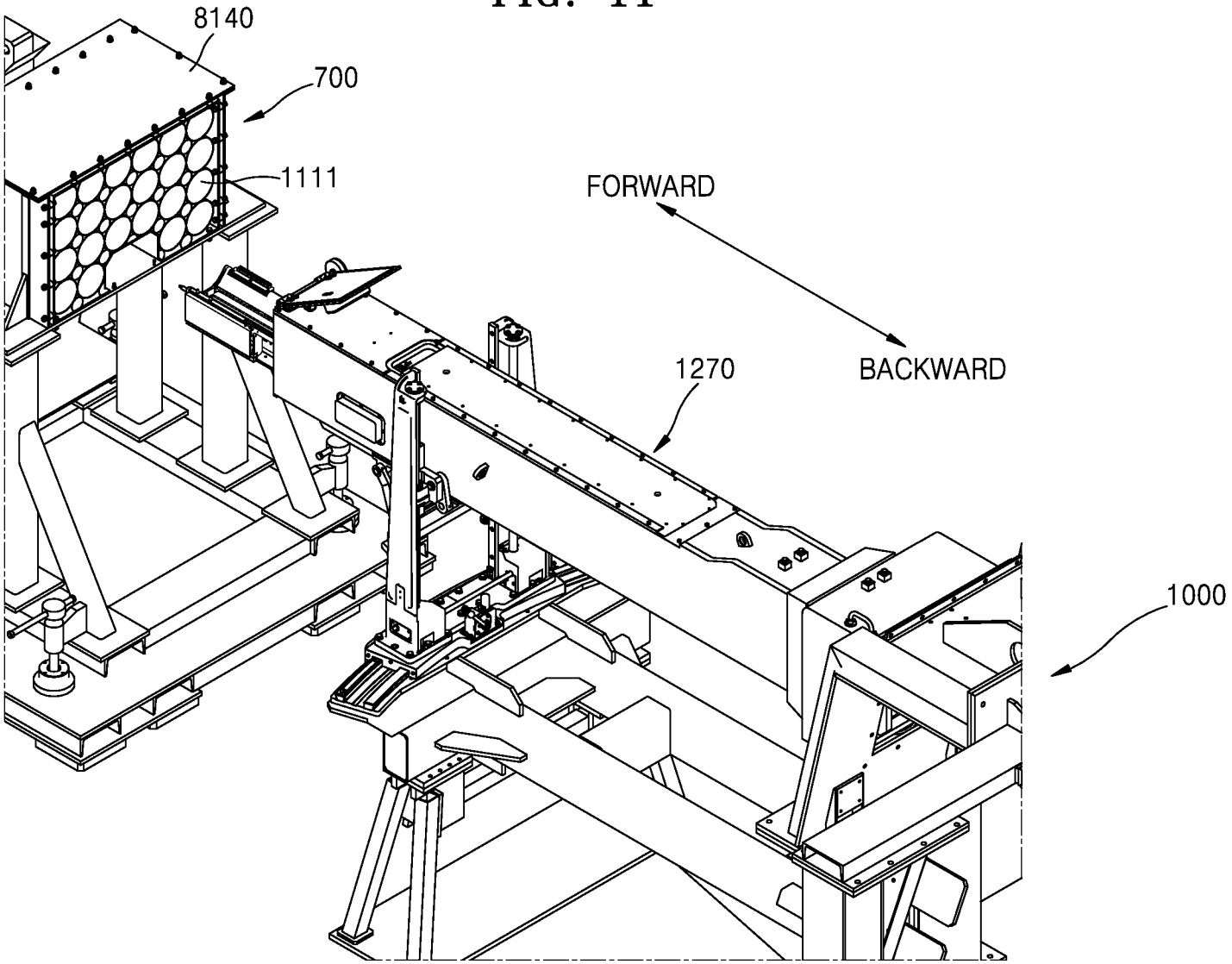
FIG. 11 is a perspective view showing a final conveyor of the ammunition carrier vehicle of FIG. 10 approaching an arbitrary shell magazine (e.g., a shell magazine in the self-propelled gun of FIG. 7).

FIG. 11 is a perspective view showing the final conveyor 1270 of the ammunition carrier vehicle 1000 of FIG. 10 approaching an arbitrary shell magazine (e.g., the shell magazine 8140 of FIG. 8 in the self-propelled gun 700 of FIG. 7). In FIG. 11, reference numeral 1111 denotes a shell inlet.

Referring to FIGS. 10 and 11, ammunition is supplied from the ammunition carrier vehicle 1000 through the final conveyor 1270 to the shell magazine 8140 or the charge magazine 8110 (see FIG. 8) in the self-propelled gun 700 (see FIG. 7).

Figure 12:
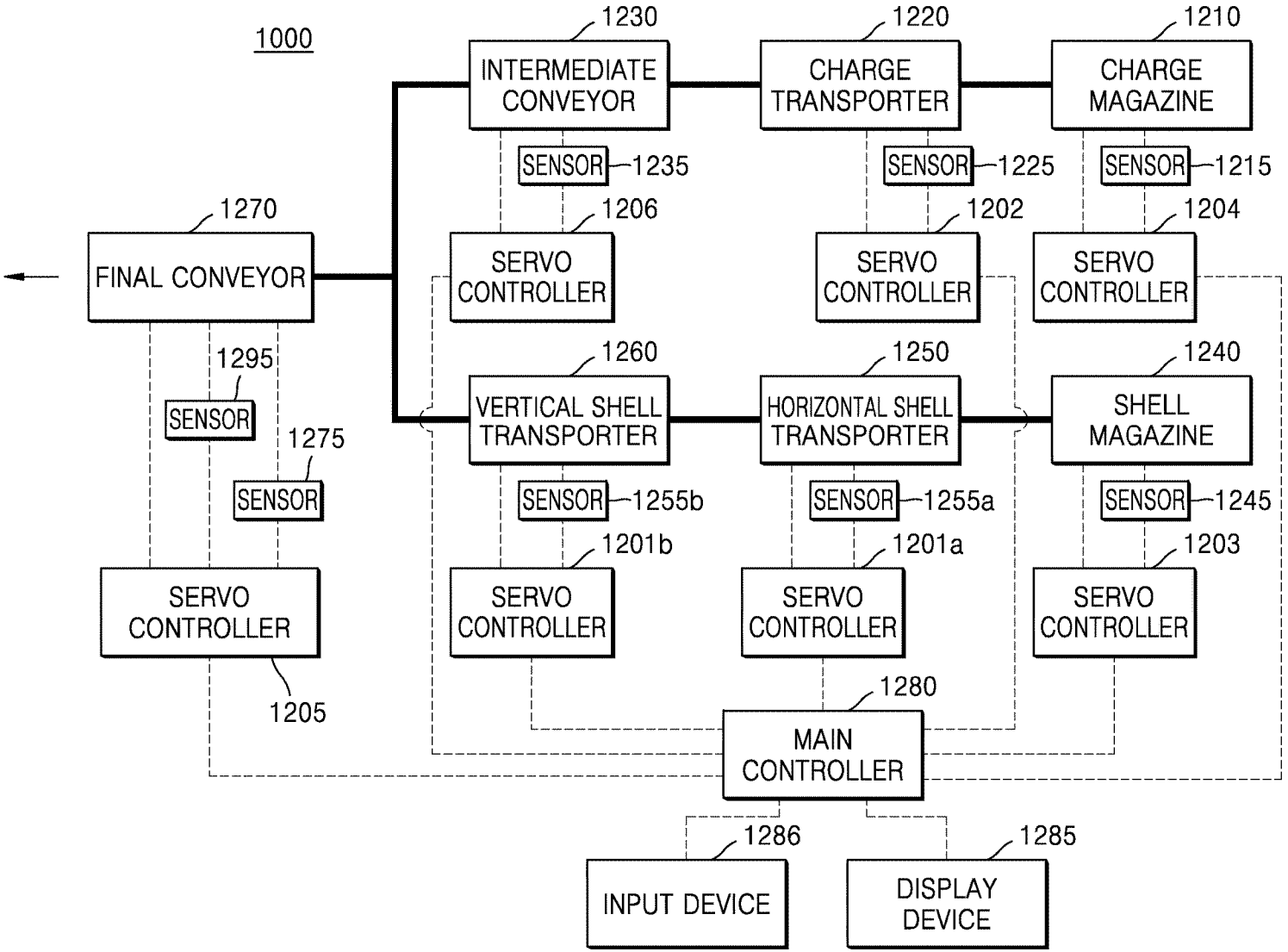
FIG. 12 is a block diagram showing the internal configuration of the ammunition carrier vehicle of FIG. 10.

FIG. 12 is a block diagram showing the internal configuration of the ammunition carrier vehicle 1000 of FIG. 10. In FIGS. 10 to 12, like reference numerals denote like elements. In FIG. 12, reference numeral 1285 denotes a display device and reference numeral 1286 denotes an input device. The internal configuration of the ammunition carrier vehicle 1000 will now be described with reference to FIG. 12.

The ammunition carrier vehicle 1000 of the current embodiment includes a main controller 1280, a shell magazine 1240 configured to store and feed shells, a charge magazine 1210 configured to store and feed charges, a conveyor (collectively denoted by 1230 and 1270) configured to convey the shells and the charges, a shell transporter (collectively denoted by 1250 and 1260) configured to provide the shells of the shell magazine 1240 to the conveyor (collectively denoted by 1230 and 1270), and a charge transporter 1220 configured to provide the charges of the charge magazine 1210 to the conveyor (collectively denoted by 1230 and 1270), and further includes a first object-position detection sensor (collectively denoted by 1255*a* and 1255*b*), a second object-position detection sensor 1225, a first servo controller (collectively denoted by 1201*a* and 1201*b*), and a second servo controller 1202.

The first object-position detection sensor (collectively denoted by 1255*a* and 1255*b*) is installed near a shell route of the shell transporter (collectively denoted by 1250 and 1260) to face a first set area (collectively denoted by a first-a set area and a first-b set area) and outputs position information of each shell in the first set area.

The second object-position detection sensor 1225 is installed near a charge route of the charge transporter 1220 to face a second set area and outputs position information of each charge in the second set area.

The first servo controller (collectively denoted by 1201*a* and 1201*b*) operates under the control of the main controller 1280 and controls operation of the shell transporter (collectively denoted by 1250 and 1260). The first servo controller (collectively denoted by 1201*a* and 1201*b*) determines whether a position range occupied by the shell in the first set area (collectively denoted by the first-a set area and the first-b set area) exceeds an allowable position range, based on the position information received from the first object-position detection sensor (collectively denoted by 1255*a* and 1255*b*). Upon determining that the position range occupied by the shell in the first set area exceeds the allowable position range, the first servo controller (collectively denoted by 1201*a* and 1201*b*) outputs an alert signal indicating a poor position.

As such, when the ammunition carrier vehicle 1000 supplies ammunition to the self-propelled gun 700, a delay in firing of the self-propelled gun 700 due to a jam or dislocation of a shell on a shell route of the shell transporter (collectively denoted by 1250 and 1260) may be prevented. Furthermore, the first servo controller (collectively denoted by 1201*a* and 1201*b*) performs the operation described above in relation to FIG. 6, on the shell which is moving.

The second servo controller 1202 operates under the control of the main controller 1280 and controls operation of the charge transporter 1220. The second servo controller 1202 determines whether a position range occupied by the charge in the second set area exceeds an allowable position range, based on the position information received from the second object-position detection sensor 1225. Upon determining that the position range occupied by the charge in the second set area exceeds the allowable position range, the second servo controller 1202 outputs an alert signal indicating a poor position.

As such, when the ammunition carrier vehicle 1000 supplies ammunition to the self-propelled gun 700, a delay in firing of the self-propelled gun 700 due to a jam or dislocation of a charge on a charge route of the charge transporter 1220 may be prevented. Furthermore, the second servo controller 1202 performs the operation described above in relation to FIG. 6, on the charge which is moving.

In the current embodiment, the conveyor (collectively denoted by 1230 and 1270) includes an intermediate conveyor 1230 and a final conveyor 1270.

The charge transporter 1220 provides the charges of the charge magazine 1210 to the intermediate conveyor 1230. The shell transporter (collectively denoted by 1250 and 1260) provides the shells of the shell magazine 1240 to the final conveyor 1270.

The charges are provided from the intermediate conveyor 1230 to the final conveyor 1270.

The shell transporter (collectively denoted by 1250 and 1260) includes a horizontal shell transporter 1250 and a vertical shell transporter 1260.

The horizontal shell transporter 1250 transports the shells of the shell magazine 1240 in a horizontal direction and provides the shells to the vertical shell transporter 1260. The vertical shell transporter 1260 transports, in a vertical direction, the shells received from the horizontal shell transporter 1250 and provides the shells to the final conveyor 1270.

The first object-position detection sensor (collectively denoted by 1255*a* and 1255*b*) includes a first-a object-position detection sensor 1255*a* and a first-b object-position detection sensor 1255*b*.

The first-a object-position detection sensor 1255*a* is installed near a shell route of the horizontal shell transporter 1250 to face the first-a set area and outputs position information of each shell in the first-a set area.

The first-b object-position detection sensor 1255*b* is installed near a shell route of the vertical shell transporter 1260 to face the first-b set area and outputs position information of each shell in the first-b set area.

The first servo controller (collectively denoted by 1201*a* and 1201*b*) includes a first-a servo controller 1201*a* and a first-b servo controller 1201*b*.

The first-a servo controller 1201*a* controls operation of the horizontal shell transporter 1250. The first-a servo controller 1201*a* determines whether a position range occupied by the shell in the first-a set area exceeds an allowable position range, based on the position information received from the first-a object-position detection sensor 1255*a*. Upon determining that the position range occupied by the shell in the first-a set area exceeds the allowable position range, the first-a servo controller 1201*a* outputs an alert signal indicating a poor position.

The first-b servo controller 1201*b* controls operation of the vertical shell transporter 1260. The first-b servo controller 1201*b* determines whether a position range occupied by the shell in the first-b set area exceeds an allowable position range, based on the position information received from the first-b object-position detection sensor 1255*b*. Upon determining that the position range occupied by the shell in the first-b set area exceeds the allowable position range, the first-b servo controller 1201*b* outputs an alert signal indicating a poor position.

In the current embodiment, the ammunition carrier vehicle 1000 further includes a third object-position detection sensor 1245 and a third servo controller 1203.

The third object-position detection sensor 1245 is installed near a shell route of the shell magazine 1240 to face a third set area and outputs position information of each shell in the third set area.

The third servo controller 1203 operates under the control of the main controller 1280 and controls operation of the shell magazine 1240. The third servo controller 1203 determines whether a position range occupied by the shell in the third set area exceeds an allowable position range, based on the position information received from the third object-position detection sensor 1245. Upon determining that the position range occupied by the shell in the third set area exceeds the allowable position range, the third servo controller 1203 outputs an alert signal indicating a poor position.

As such, when the ammunition carrier vehicle 1000 supplies ammunition to the self-propelled gun 700, a delay in firing of the self-propelled gun 700 due to a jam or dislocation of a shell on a shell route of the shell magazine 1240 may be prevented. Furthermore, the third servo controller 1203 performs the operation described above in relation to FIG. 6, on the shell which is moving.

In the current embodiment, the ammunition carrier vehicle 1000 further comprises a fourth object-position detection sensor 1215 and a fourth servo controller 1204.

The fourth object-position detection sensor 1215 is installed near a charge route of the charge magazine 1210 to face a fourth set area and outputs position information of each charge in the fourth set area.

The fourth servo controller 1204 operates under the control of the main controller 1280 and controls operation of the charge magazine 1210. The fourth servo controller 1204 determines whether a position range occupied by the charge in the fourth set area exceeds an allowable position range, based on the position information received from the fourth object-position detection sensor 1215. Upon determining that the position range occupied by the charge in the fourth set area exceeds the allowable position range, the fourth servo controller 1204 outputs an alert signal indicating a poor position.

As such, when the ammunition carrier vehicle 1000 supplies ammunition to the self-propelled gun 700, a delay in firing of the self-propelled gun 700 due to a jam or dislocation of a charge on a charge route of the charge magazine 1210 may be prevented. Furthermore, the fourth servo controller 1204 may perform the operation described above in relation to FIG. 6, on the charge which is moving.

In the current embodiment, the ammunition carrier vehicle 1000 further includes a fifth-a object-position detection sensor 1275, a fifth-b object-position detection sensor 1295, and a fifth servo controller 1205.

The fifth-a object-position detection sensor 1275 is installed near a shell route of the final conveyor 1270 to face a fifth-a set area and outputs position information of each shell in the fifth-a set area.

The fifth-b object-position detection sensor 1295 is installed near a charge route of the final conveyor 1270 to face a fifth-b set area and outputs position information of each charge in the fifth-b set area.

The fifth servo controller 1205 operates under the control of the main controller 1280, controls operation of the final conveyor 1270, and determines whether a position range occupied by the shell or the charge in the fifth-a or fifth-b set area exceeds an allowable position range, based on the position information received from the fifth-a or fifth-b object-position detection sensor 1275 or 1295. Upon determining that the position range occupied by the shell or the charge in the fifth-a or fifth-b set area exceeds the allowable position range, the fifth servo controller 1205 outputs an alert signal indicating a poor position.

As such, when the ammunition carrier vehicle 1000 supplies ammunition to the self-propelled gun 700, a delay in firing of the self-propelled gun 700 due to a jam or dislocation of a shell or a charge on the final conveyor 1270 may be prevented. Furthermore, the fifth servo controller 1205 may perform the operation described above in relation to FIG. 6, on the shell and the charge which are moving.

In the current embodiment, the ammunition carrier vehicle 1000 further includes a sixth object-position detection sensor 1235 and a sixth servo controller 1206.

The sixth object-position detection sensor 1235 is installed near a charge route of the intermediate conveyor 1230 to face a sixth set area and outputs position information of each charge in the sixth set area.

The sixth servo controller 1206 operates under the control of the main controller 1280 and controls operation of the intermediate conveyor 1230. The sixth servo controller 1206 determines whether a position range occupied by the charge in the sixth set area exceeds an allowable position range, based on the position information received from the sixth object-position detection sensor 1235. Upon determining that the position range occupied by the charge in the sixth set area exceeds the allowable position range, the sixth servo controller 1206 outputs an alert signal indicating a poor position.

As such, when the ammunition carrier vehicle 1000 supplies ammunition to the self-propelled gun 700, a delay in firing of the self-propelled gun 700 due to a jam or dislocation of a charge on the intermediate conveyor 1230 may be prevented. Furthermore, the sixth servo controller 1206 performs the operation described above in relation to FIG. 6, on the charge which is moving.

As described above, in an ammunition monitoring apparatus, a self-propelled gun, and an ammunition carrier vehicle according to embodiments of the present disclosure, a position of a shell or a charge may be determined using at least one object-position detection sensor and an alert signal may be output when the shell or the charge is poorly positioned.

Therefore, when a self-propelled gun fires or an ammunition carrier vehicle supplies ammunition, a delay in firing due to a jam or dislocation of ammunition may be prevented.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by one of ordinary skill in the art that various changes in form and details may be made therein without departing from the scope as defined by the following claims.

INDUSTRIAL APPLICABILITY

The present disclosure is applicable to industrial apparatuses related to a conveyor.

The invention claimed is:

1. An ammunition monitoring apparatus comprising:

at least one object-position detection sensor installed near a shell or charge route to face at least one set area, the at least one object-position detection sensor configured to output position information of a shell or charge in the at least one set area, the position information including first information corresponding to a first outer edge of the shell or charge in a view and second information corresponding to a second outer edge of the shell or charge, opposite to the first outer edge, in the view; and a controller configured to determine whether a position range occupied by the shell or the charge in the at least one set area exceeds an allowable position range that is larger than a size of the shell or charge, based on the position information, including the first information and the second information, received from the at least one object-position detection sensor, and to output an alert signal indicating a poor position upon determining that the position range occupied by the shell or the charge in the at least one set area exceeds the allowable position range.

2. The ammunition monitoring apparatus of claim 1, wherein the at least one object-position detection sensor comprises at least one camera, and wherein the controller is further configured to set, in a set area of the at least one set area, a virtual shape larger than a shape of the shell or the charge and to output the alert signal upon determining that the shape of the shell or the charge in the set area exceeds the virtual shape.

3. The ammunition monitoring apparatus of claim 1, wherein the at least one object-position detection sensor comprises at least one two-dimensional (2D) laser sensor configured to obtain position information of a single horizontal line of the shell or the charge by irradiating a single horizontal linear laser beam onto a set area of the at least one set area, the position information comprising a distance coordinate (Y-axis coordinate) and a horizontal-direction coordinate (X-axis coordinate) of every point of the single horizontal line of the shell or the charge, and wherein the controller is further configured to set an allowable range of the distance coordinate (Y-axis coordinate) and an allowable range of the horizontal-direction coordinate (X-axis coordinate), and to output the alert signal upon determining that the distance coordinate (Y-axis coordinate) or the horizontal-direction coordinate (X-axis coordinate) received from the 2D laser sensor exceeds the allowable range.

4. The ammunition monitoring apparatus of claim 1, wherein the at least one object-position detection sensor comprises at least one three-dimensional (3D) laser sensor configured to obtain position information of the shell or the charge by irradiating laser beams of horizontal and vertical directions onto a set area of the at least one set area, the position information comprising a distance coordinate (Y-axis coordinate), a horizontal-direction coordinate (X-axis coordinate), and a vertical-direction coordinate (Z-axis coordinate) of every point of the shell or the charge, and wherein the controller is further configured to set an allowable range of the distance coordinate (Y-axis coordinate), an allowable range of the horizontal-direction coordinate (X-axis coordinate), and an allowable range of the vertical-direction coordinate (Z-axis coordinate), and to output the alert signal upon determining that the distance coordinate (Y-axis coordinate), the horizontal-direction coordinate (X-axis coordinate), or the vertical-direction coordinate (Z-axis coordinate) received from the 3D laser sensor exceeds the allowable range.

5. The ammunition monitoring apparatus of claim 1, wherein the at least one set area comprises multiple set areas, wherein the at least one object-position detection sensor comprises multiple object-position detection sensors respectively corresponding to the multiple set areas, and wherein the controller is further configured to set a reference position range smaller than the allowable position range, to store rates of the position range occupied by the shell or the charge between the reference position range and the allowable position range in the multiple set areas, and to output a correction request signal for a set area in which a rate of the position range occupied by the shell or the charge continuously increases.

6. The ammunition monitoring apparatus of claim 1, wherein the controller is further configured to determine whether the shell or the charge is inverted in the at least one set area, based on the position information received from the at least one object-position detection sensor, and to output an alert signal indicating invertedness upon determining that the shell or the charge is inverted in the at least one set area.

7. The ammunition monitoring apparatus of claim 1, wherein the controller is further configured to determine whether a charge in the at least one set area has a set size, based on the position information received from the at least one object-position detection sensor, and to output an alert signal indicating an incorrect charge upon determining that the charge does not have the set size.

8. The ammunition monitoring apparatus of claim 1, wherein the controller is further configured to count shells or charges passing through the at least one set area, based on the position information received from the at least one object-position detection sensor.

* * * * *